United States Patent [19]

Marrero

[11] 4,035,052

[45] July 12, 1977

[54] QUICK CONNECTOR ELECTRICAL UTILITY BOX

[76] Inventor: Louis Marrero, 13004 Via del Valedor, San Diego, Calif. 92129

[21] Appl. No.: 359,982

[22] Filed: May 14, 1973

[51] Int. Cl.[2] ..... H01R 13/60

[52] U.S. Cl. ..... 339/122 F; 339/99 R

[58] Field of Search ..... 339/19, 122, 133, 134, 339/135, 95 D, 96, 98, 99, 174, 23, 24; 248/225, 224

[56] References Cited

U.S. PATENT DOCUMENTS

| | | | |
|---|---|---|---|
| 2,673,968 | 3/1954 | Smith | 339/99 R |
| 2,787,435 | 4/1957 | Shields | 248/225 |
| 3,054,994 | 9/1962 | Haram | 339/147 |
| 3,163,482 | 12/1964 | Hubbell et al. | 339/97 P |
| 3,170,744 | 2/1965 | Farnsworth | 339/125 R |
| 3,510,822 | 5/1970 | Patterson | 339/164 M |
| 3,663,924 | 5/1972 | Gerlat | 339/28 |
| 3,718,888 | 2/1973 | Pasternak | 339/98 |

*Primary Examiner*—Robert A. Hafer
*Attorney, Agent, or Firm*—Ralph S. Branscomb

[57] ABSTRACT

A quickly-installed electrical utility box which can be used as an electrical outlet or as a mounting and connection means for a toggle switch. The device includes a wiring box having the usual outlet holes which are internally connected to snap-on cable terminals which make secure electrical connections without requiring screws or the use of tools. The wiring box is slideably received in a mounting bracket which is fastened to the studding of a building, and a locking means on the bracket releasably locks the wiring box against sliding at several different positions, so that after installation of the utility box and the wallboard, the box can be slid in or out to the position in which it is flush with the wallboard.

8 Claims, 10 Drawing Figures

QUICK CONNECTOR ELECTRICAL UTILITY BOX

BACKGROUND OF THE INVENTION

The present invention relates to electrical utility boxes for wall outlets and wall switch installations.

Outlet and switch connections have conventionally been made in a junction box which is fastened to a stud of the building prior to the application of plaster, or in more recent times, the installation of wallboard. A main cable is laid up to the junction box and the end is stripped, the ends of the individual wires are stripped, and the ends inserted through an opening in the junction box. A similar operation generally must be performed on the end of a second cable which leads from the first junction box to another box more remote from the power supply, and if the junction box is to house a switch rather than an outlet, or an outlet controlled by a switch, yet a third cable must be installed to connect with the load or the switch.

After the wallboard has been installed and a hole cut, the stripped wires are pulled through the hole and fastened to the terminals of the switch or outlet. The fastening generally involves the bending of the individual bared wires around screw terminals and the tightening down of the screws to make a secure connection. This procedure is tedious and time consuming, and with the present-day high cost of labor and increased demands for convenience outlets and switches, is expensive as well.

Outlets have been developed which accelerate the installation process such as the devices represented in U.S. Pat. Nos: 2,946,838, 3,160,458 and 3,218,596. These devices represent improvements over the older outlets but nonetheless either involving the use of screw connections or connectors which fail to securely hold the wires in place or make sound electrical contact.

Another troublesome aspect of present utility box installation is the difficulty of mounting the box such that the front surface is flush with the finished wall, a problem because the utility box must be mounted prior to the installation of the wall. Although the problem was more serious prior to the widespread use of wallboard of fairly uniform thickness, proper allignment still requires careful measurement during installation, the procedure being further complicated by the several thicknesses in which the wallboard is produced. A testimonial to the reality of the problem is found in U.S. Pat. No. 1,961,728, which discloses an outlet box with front edges which are easily broken off, eliminating the need for careful measurement.

SUMMARY OF THE INVENTION

It is the object of this invention to solve the above-mentioned problems by providing an electrical utility box which is quickly and easily connectable to power wires without screws or requiring the use of tools, and which is easily adjustable after mounting so that the outlet box can be made flush with the surface of the completed wall without re-mounting. The utility box includes standard electrical outlet openings, and can be wired to accomodate a toggle switch which is plugged into the outlet and secured to the utility box.

The utility box includes a wiring box which has a plurality of guide holes through which the stripped ends of cable wires are inserted and a plurality of the conductive, flexible jaws which are adjacent the holes and receive the inserted wires. A clamp means with an externally projecting tab is disposed in the wiring box adjacent the jaws and is arranged such that pressure on the tabs crimps the jaws tightly around the wires. Appropriate internal electrical connections join the jaws to contracts adjacent the respective outlet openings.

The wiring box is slidably received in a mounting bracket which is mounted on a stud of a building prior to the installation of wallboard, and releasable catch allows positioning of the box at several locations in the bracket so that the final alignment of the utility box with the completed wall is not dependent on the rough positioning of the bracket made during a prior stage of construction.

DETAILED DESCRIPTION OF THE PREFERRED EMBODIMENT

Figure 1:
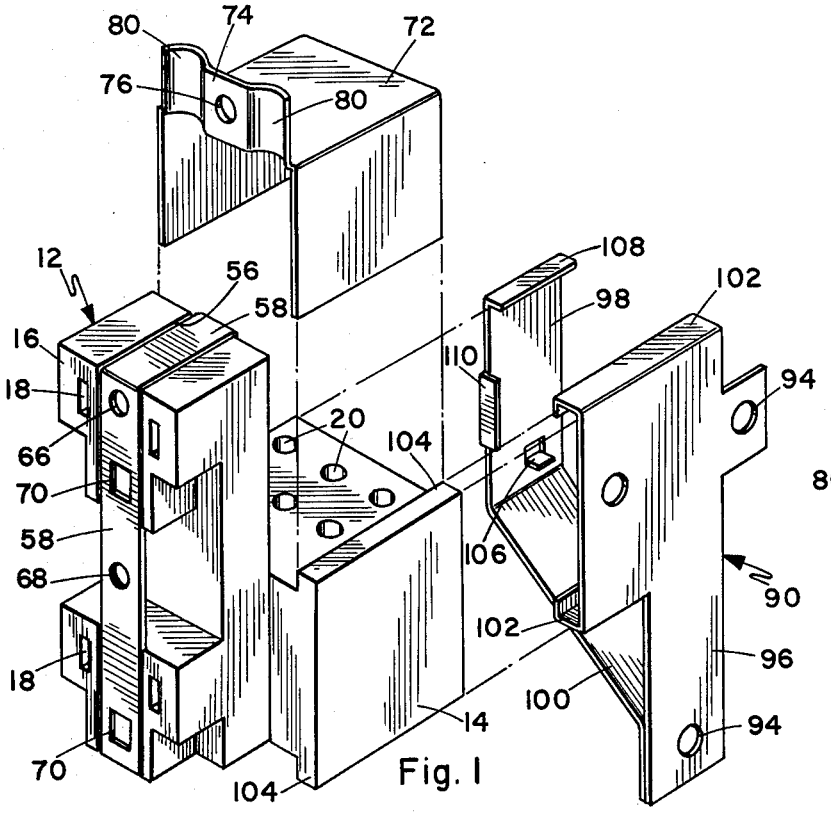
FIG. 1 is an exploded perspective view of the electrical outlet and mounting bracket.
Figure 2:
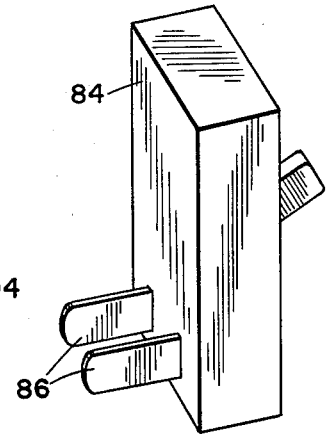
FIG. 2 is a perspective view of a plug-in switch unit used with the outlet.
Figure 3:
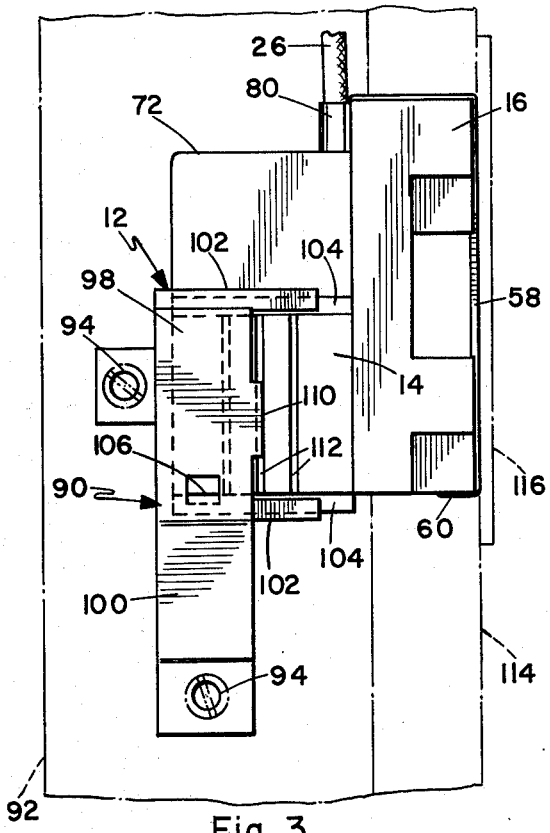
FIG. 3 is a side elevation view of the assembled outlet and bracket, portions of a wall and stud being indicated in broken line.

The invention includes a wiring box 12 consisting of two parts, a junction box 14 and an outlet receptacle 16, which are preferably separately molded from plastic and subsequently jointed together so that they communicate internally.

The front of the receptical 16 has outlet openings 18 which are preferably four in number and disposed in two pairs, each dimensioned to receive a standard electrical plug, in typical double outlet fashion. The junction box 14 has a plurality of guide holes 20 in the top through which the bared ends 22 of power wires 24 from a main cable 26 are insertable.

Disposed inside the wiring box and retained in place by the particular configuration of the inner walls of the wiring box are a pair of electrical connectors 28 whose function is to make contact between the spade terminals 30 of an electrical plug 32 and the power wires 24. For this purpose each of the connectors 28 consists of a conductor portion 34 including two sheath contacts 36 which are aligned with two of the outlet openings 18 to accept the spade terminals, and a terminal means 38 which secures and makes contact with the power wires. An additional isolated terminal means 40 simply makes contact between two wires and has no conductor portion leading to an outlet opening.

Each terminal means is preferably provided with two flexible conductive jaws 42, individually identified as 42 *a*, *b*, *c*, *d*, and *e*. The jaws are preferably integral with the terminal means, and the terminal means integral with the conductor portion 34, each electrical connector 28 being stamped out of a single sheet of metal. The jaws 42 are formed in pairs from the single sheet by forming a U-bend and striking inwardly the metal adjacent each slit, as can readily be understood by reference to the drawings. The isolated terminal means 40 is formed in a similar manner.

The terminal means 38 and 40 are disposed within the junction box such that the jaws 42 are immediately beneath the guide holes 20, and are dimensioned to easily receive the stripped ends of a power wires inserted through the respective holes. Beneath the terminal means is a clamp 44 which loosely rests on shoulders 46 provided by the junction box. The clamp is constructed in the shape of an up-facing E-bar 48, which is a bar with two parallel vertical slots 50 in the top thereof, and has a tab 52 which projects through an opening 54 in the bottom of the junction box. The slots are slightly smaller than the width of the terminal means 38 and 40.

Figure 7:
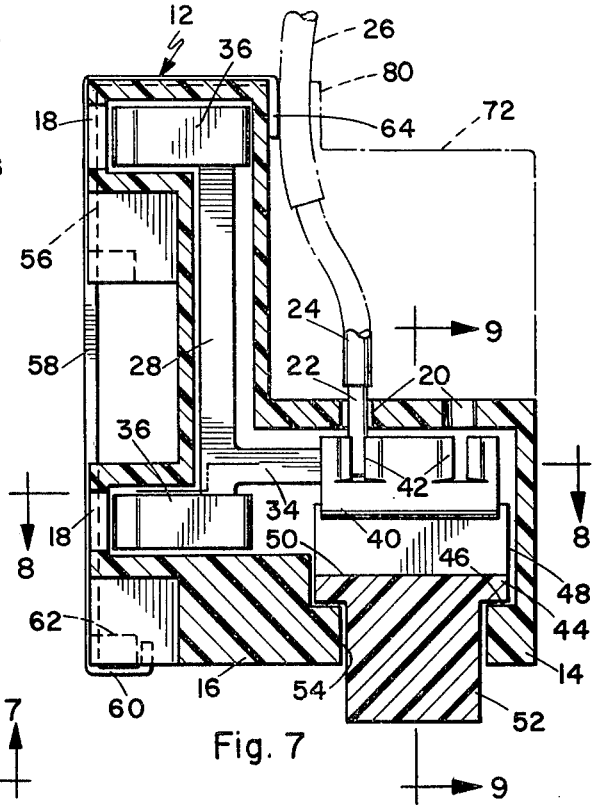
FIG. 7 is a sectional view taken on line 7—7 of FIG. 6.
Figure 6:
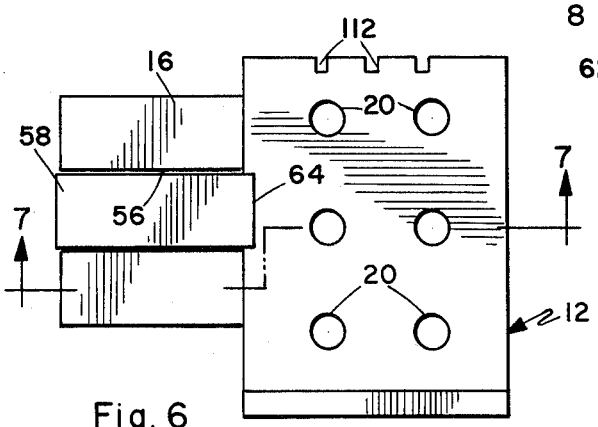
FIG. 6 is an enlarged top plan view of the outlet unit only.
Figure 8:
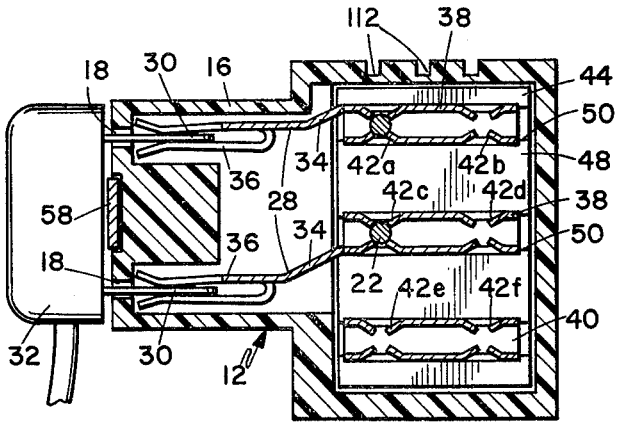
FIG. 8 is a sectional view taken on line 8—8 of FIG. 7.

In order to make the power wire connections, first a main cable 26 is stripped, then the individual power wires 24 are stripped, then the individual power wires 24 are stripped, and the bare ends 22 of the wires are inserted through the guide holes 20 and into the respective jaws 42, as best illustrated in FIGS. 7 and 8. Then the clamp 44 is manually pressed upward, and the slots 50, which were in line with and immediately below the terminal means 38 and 40, slide over the terminal means, biasing the sides of the U-bend together and thus crimping the jaws tightly around the power wires.

Figure 9:
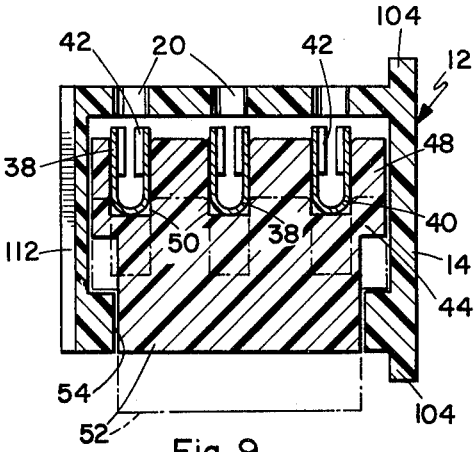
FIG. 9 is a sectional view taken on line 9—9 of FIG. 7.
Figure 10:
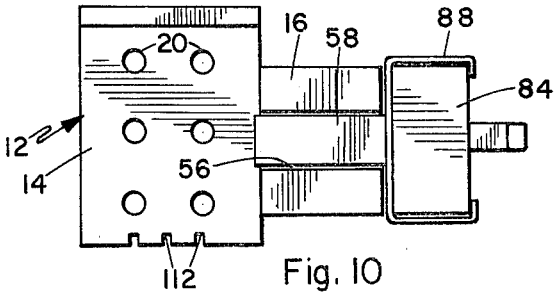
FIG. 10 is a top plan view of the outlet with the switch unit attached.

The clamp 44 is illustrated in the clamped position, and in the unclamped position in phantom, in FIG. 9. When in the clamped position the bottom of the tab 52 is flush with the bottom of the junction box so that the smooths contours of the wiring box are retained. The wires are then securely fastened in the crimped jaws by a single motion of the fingers, the operation requiring no tools and very little time.

A shallow channel 56 is molded into the top, front, and bottom of the recepticle 16, and a mounting brace 58 seats in the channel and has a doubly-bent bottom portion 60, which engages a block 62 which is molded into the wiring box, and a top portion which has a downwardly bent end 64 which grips the upper back portion of the wiring box. The brace has a hole 66 in its upper face portion, and a hole, not shown, in the end 14, both holes being aligned with a bore, not shown, through the entire upper part of the outlet receptical 16. A threaded mounting hole 68 is centrally located in the front portion of the brace.

The brace 58 is conductive and doubles as a grounding strap as explained hereinafter, and for that reason has ground holes 70 which receive the ground prongs of three-pronged plugs. Each of the holes 70 are formed by punching out three sides and striking the resulting flap rearwardly, the struck flap, not shown, acting as a contact for the inserted ground prong.

A box-like cover 72 is provided to protect the top of the junction box and the stripped wires which are inserted therethrough. The front of the cover has an upwardly projecting flange 74 which has a hole 76 therethrough by means of which the cover is attached by a screw 78 to the wiring box. The screw 78 can be very short and engage only the down-bent end 68 of the mounting brace, or it can be long enough to extend completely through the hole in end portion 64, through the bore in the receptacle 16, and engage the threaded hole 66 in the brace.

The sides of the flange 74 have concave portions 80 which permit the entry of cables 26, each concavity being of sufficient size to admit one or more triple wired cables when the cover is in place. The third wire in a three-wire cable is a ground wire, and if this type of cable is used, the two power wires are connected as described above, and the ground wire is stripped and the end is wedged into one of the slits 82 which are marginally provided in the cover for that purpose. This wedged connection is accomplished prior to the mounting of the cover, and when the cover is mounted completes the ground connection from the flap contacts adjacent ground holes 70, through the mounting brace 58, through the cover 72, and finally to the ground wire.

When the utility box is used as an ordinary outlet, a two-or three-wire incoming power cable would be stripped and the individual wires inserted in the jaws of two separate terminal means, for example in jaws **42*a* and 42*c*, and the ground wire, if there is one, would be wedged into one of the slits 82. If a second outlet further removed from the power source is to be supplied, and outgoing cable would be required with the individual wires being inserted into the jaws 42*b* and 42*c*, the ground wire being inserted in the remaining slit 82. The clamp 44 would then be engaged by pressing the tab 52 flush with the junction box, thereby clamping the wires in the respective jaws, and the cover 72** would be secured to the receptacle.

It is sometimes desired to wire a wall outlet to a controlling wall switch. To achieve this end the isolated terminal means 40 is useful. The incoming power wires would be inserted in jaws **42*a* and 42*c*, the outgoing wires would be inserted in jaws 42*b* and 42*c*, and the control wires leading to the wall switch would be connected to jaws 42*d* and 42*f***, in series with both outlets. Other possible connection arrangements are possible.

The utility box can also be used as a wall switch receptacle. In this alternative use, a toggle switch 84 is mounted on the receptacle by the of a screw not shown which engages the threaded mounting hole 68.

In one exemplary wiring arrangement of the utility box for use as a switch receptacle, the incoming power wires would be attached to jaws **42*c* and 42*e*, and the supply wires for the light or appliance to be controlled would be secured in the jaws 42*b* and 42*f***.

Additional outlet openings 18 and accompanying internal connections could obviously be added to the utility box without changing the basic concept, and additional jaw means might prove desireable. For example, in the toggle switches arrangement, a third jaw added to the isolated terminal means 40 would enable a third pair of wires to be powered through the utility box, either controlled by or independent of the toggle switch. Embellishments of the invention of this nature have been omitted from the description and drawings for the sake of simplicity, but are intended to fall within the invention as claimed.

Figure 4:
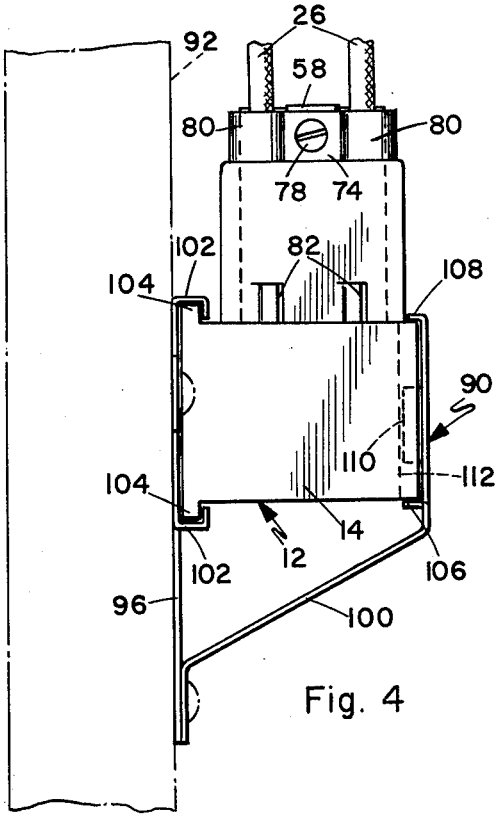
FIG. 4 is a rear elevation view of the assembly of FIG. 3.
Figure 5:
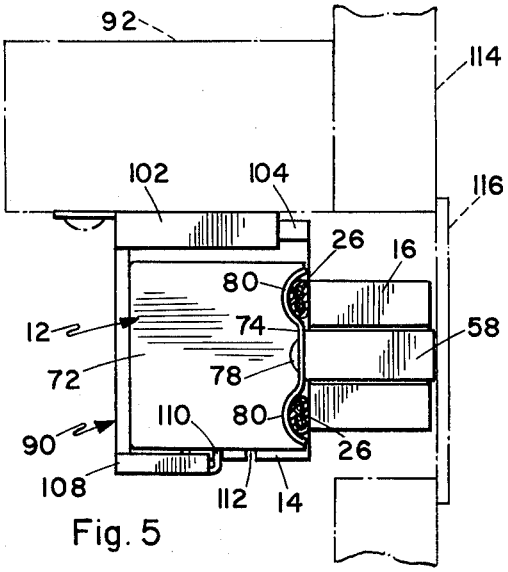
FIG. 5 is a top plan view of the assembly of FIG. 3.

The entire wiring box is secured in a mounting bracket 90 which is fastened to a stud 92 or other structural member by means of screws or nails driven into the stud through the nailholes 94 in the bracket. As best illustrated in FIGS. 1 and 4, the mounting bracket is preferably of one-piece construction and consists of a mounting side 96 attached to an outer side 98 by means of an inclined bottom 100. The portions of the mounting side having nail holes therein extend beyond the limits of the outer side so that ready access is provided to the holes for nailing or screwing the bracket to the stud.

The top of the mounting side 96 of the bracket contains a downward double bend, and portion of the bracket about midway down has a upward double bend, thus defining a pair of parallel tracks 102. The junction box portion 14 of the wiring box has two parallel rails 104 on one side thereof which mate with the tracks 102 so that the wiring box can slide into the bracket with the rails snugly riding in the channels. These tracks and channels provide the main support for the wiring box, and secure the box against all movement other than one-dimensional sliding.

To provide additional support the outer side 98 of the bracket has a ledge 106 which supports the bottom of the junction box, a flange 108 on the top thereof which rides on the top of the junction box, and a vertical tongue 110 which is an inwardly-bent tab projecting from the forward edge of the outer side of the bracket. The function of the tongue is to engage one of the grooves 112 in the side of the junction box, thus serving as a locking means to prevent the wiring box from sliding back and forth in the bracket. Three grooves are illustrated, although more would be included and perhaps should be.

The entire bracket is preferably constructed from resilient metal so that the outer side 98 can be displaced outwardly to allow passage of the junction box past the projecting tongue 110. When the junction box is inserted a certain distance into the bracket, the tongue, which is biased against the box by the spring action of the resilient bottom 100 of the bracket, snaps into the first of the grooves 112 and prevents further sliding. The wiring box is now firmly secured in the bracket.

The mounting bracket is generally attached to a stud of the building prior to the installation of wallboard, and a hole cut to provide access to the utility box. The wiring box may be wired before or after the installation of the wallboard. Because the wallboard comes in more than one thickness, and the utility box may be used as an outlet or with a relatively thick switch attached thereto, the forward disposition of the wiring box, absent tediously precise measurement prior to mounting of the bracket 90, will not likely be such that the front surface of the wiring box, or attached toggle switch, is properly flush with the outer surface of the wall board 114. In this likely situation, a knife or screwdriver can be inserted from either side of the wall between the junction box and the outer side 98 of the bracket, and the side 98 can be pried out such that the tongue 110 is cleared from the groove in which is rested, this allowing the wiring box to be slid in or out until proper positioning is attained. The tongue is then allowed to snap back into the appropriate groove securing the wiring box flush with the wall. A facia plate 116 can then be attached to the wiring box by means of a central screw engaging the mounting hole 68. In case the toggle switch is used, no facia plate is necessary.

The time necessary to install the utility box in a building, and the wires in the utility box, is considerably reduced compared to the time involved in present-day utility box installation. The individual parts of the device are simply manufactured, the total manufacturing cost being comparable to costs of utility boxes in current use, and because one unit is used for both electrical outlets and switch installations, inventory and handling costs are also reduced. The utility box herein disclosed and claimed, being quickly installed, quickly connected, versatile, and inexpensive, is a practical addition to modern rapid-construction devices and techniques.

I claim:

1. An electrical utility box assembly comprising:

a. a mounting bracket having a plurality of parallel tracks integral with said mounting bracket;

b. a wiring box with outlet openings therein and having i. a plurality of parallel rails complementing said tracks such that said wiring box is slideably receivable in said bracket, and ii. an electrical connection means mounted in said box and including a. terminal means connectable to wires, and b. a conductor means connected to certain of said terminal means and accessible from without said wiring box through said outlet openings;

iii. a groove in the side thereof; and c. a locking means for securing said wiring box against sliding in said bracket comprising:

i. a tongue integral with said bracket which registers with said groove when said wiring box is inserted a predetermined distance into said bracket; and ii. a spring means biasing said tongue into said groove.

2. The structure of claim 1 wherein said wiring box has a plurality of parallel grooves in the side thereof and said tongue is registerable with any selected one of said grooves, whereby said locking means is selectively secureable in a plurality of positions.

3. Structure according to claim 1 and including a switch element having spade terminals and wired to selectively make and break contact between said spade terminals, said terminals receivable in said outlet openings and said wiring box being capable of being wired such that said switch controls the current therethrough and thus another fixture wired to said wiring box, whereby said wiring box doubles as an outlet and, in combination with said switch element, a switch; and b. means of securing said switch to said wiring box.

4. An electrical utility box assembly comprising:

a. a wiring box having outlet openings therein;

b. terminal means disposed in said wiring box for engaging power wires comprising:

i. flexible conductive jaws to receive the ends of power wires, ii. clamp means disposed adjacent to the jaws and having slots therein narrower than the width of said jaws, iii. said clamp means being capable of forced engagement with said jaws such that said slot embraces a jaw and crimps said jaw tightly around the end of wire received therein:

c. electrical connection means electrically connected to certain of said jaws and accessible from outside said wiring box via said outlet openings; and d. means of mounting said wiring box on a structural member of a building.

5. The structure of claim 4 wherein said wiring box has a plurality of guide apertures therein, each of said apertures being adjacent to and providing a guide channel into one of said jaws to facilitate the insertion of said power wires.

6. The structure of claim 5 and including an electrically conductive cover mountable on said wiring box to cover said guide apertures and power wires inserted therein, said cover:

a. having at least one opening to admit at least one cable, and b. having at least one conductive attachment means thereon for securing and making electrical contact with a least one ground wire, and c. being electrically coupled to at least one contact adjacent at least one of said outlet openings when said cover is mounted on said wiring box.

7. The structure of claim 6 wherein said attachment means is a marginal slit in said conductive cover to receive in wedged relationship the exposed end of a ground wire.

8. The structure of claim 4 wherein each of said conductor means is integrally formed with at least one said jaw.

* * * * *